United States Patent [19]

Diehm et al.

[11] 3,948,133

[45] Apr. 6, 1976

[54] ROTARY BLADE CUTTING ASSEMBLY

[75] Inventors: Kenneth F. Diehm, Temple; Lawrence H. Gruber, Sinking Spring, both of Pa.

[73] Assignee: Trim-Master Corporation, Temple, Pa.

[22] Filed: Sept. 27, 1974

[21] Appl. No.: 509,761

[52] U.S. Cl. ..... 83/556; 83/356.3; 83/582; 83/593

[51] Int. Cl.[2] ..... B26D 5/08

[58] Field of Search ..... 83/354, 355, 356, 356.1, 83/356.3, 556, 564, 582, 593

[56] References Cited

UNITED STATES PATENTS

| | | | |
|---|---|---|---|
| 2,372,780 | 4/1945 | Hess | 83/593 |
| 2,615,517 | 10/1952 | Di Cicco | 83/593 X |
| 3,442,168 | 5/1969 | Gatto | 83/356 X |
| 3,648,556 | 3/1972 | Hamilton et al. | 83/355 X |
| 3,818,851 | 6/1974 | Marforio | 83/593 X |

*Primary Examiner*—Willie G. Abercrombie

*Attorney, Agent, or Firm*—Blum, Moscovitz, Friedman & Kaplan

[57] ABSTRACT

A rotary blade cutting assembly wherein a fixed cutting blade and a rotary cutting blade are rotated into radial alignment to thereby effect a cutting operation is provided for performing sequential cutting operations on continuously moving material. The rotary blade is rotated out of alignment with the fixed blade to thereby allow the material to be cut to be positioned with respect to a cutting edge defined by the fixed blade to thereby provide for intermittent cutting of the material by the rotary blade mechanism.

7 Claims, 4 Drawing Figures

ROTARY BLADE CUTTING ASSEMBLY

BACKGROUND OF THE INVENTION

This invention is directed to a material cutting assembly and in particular to a rotary blade mechanism wherein a rotating blade is rotated in a single rotational direction to effect a cutting operation for each rotation of the rotary blade. Heretofore, cutting devices for such materials as tape, ribbon, elastic, strip metal and the like, have utilized either the guillotine principle or scissors principle wherein a blade is brought into cutting contact with a fixed blade to thereby effect a cutting operation and immediately thereafter, the motion of the movable blade is reversed to thereby return the movable blade to its starting position. Because the next piece of material to be cut must be moved into position, the movable blade must be removed from contact with the fixed blade to allow positioning of the material. Thus, the time required to remove the blade in a direction reverse from the cutting direction to thereby reset same for the next cutting operation, is greater than the time needed to position the next piece of material to be cut, such reverse motion movable blade material cutting mechanisms being less than completely satisfactory.

SUMMARY OF THE INVENTION

Generally speaking, in accordance with the invention, an improved rotary blade cutting mechanism wherein the time of a cutting cycle is reduced is provided. The cutting assembly includes a fixed cutting blade and a rotary cutting blade, the rotary cutting blade being adapted to rotate into radial alignment with the fixed blade to thereby effect a cutting operation. A mechanism intermittently rotates the rotary cutting blade into radial alignment with the fixed blade once during each pass thereof.

Accordingly, it is an object of this invention to provide an improved material cutting assembly having a rotary cutting blade.

Another object of this invention is to provide an improved rotary blade cutting assembly wherein the time to complete a cutting operation is reduced.

Still another object of this invention is to provide an improved rotary blade cutting assembly wherein the material to be cut can be fed and cut at high speeds.

Still other objects and advantages of the invention will in part be obvious and will in part be apparent from the specification.

The invention accordingly comprises the features of construction, combination of elements, and arrangements of parts which will be exemplified in the construction hereinafter sets forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
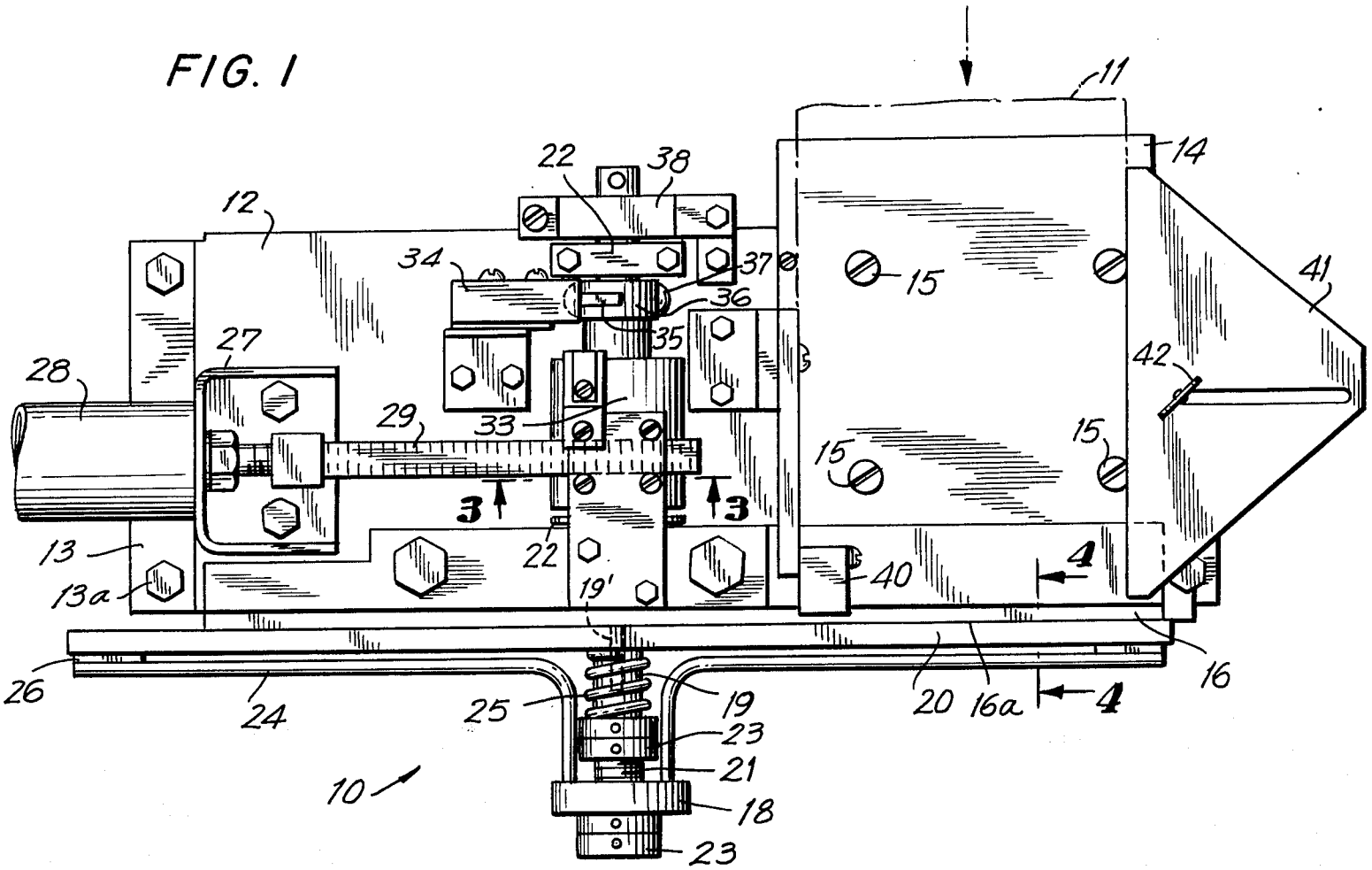
FIG. 1 is a plan view of the rotary cutting blade assembly constructed in accordance with a preferred embodiment of the instant invention.
Figure 2:
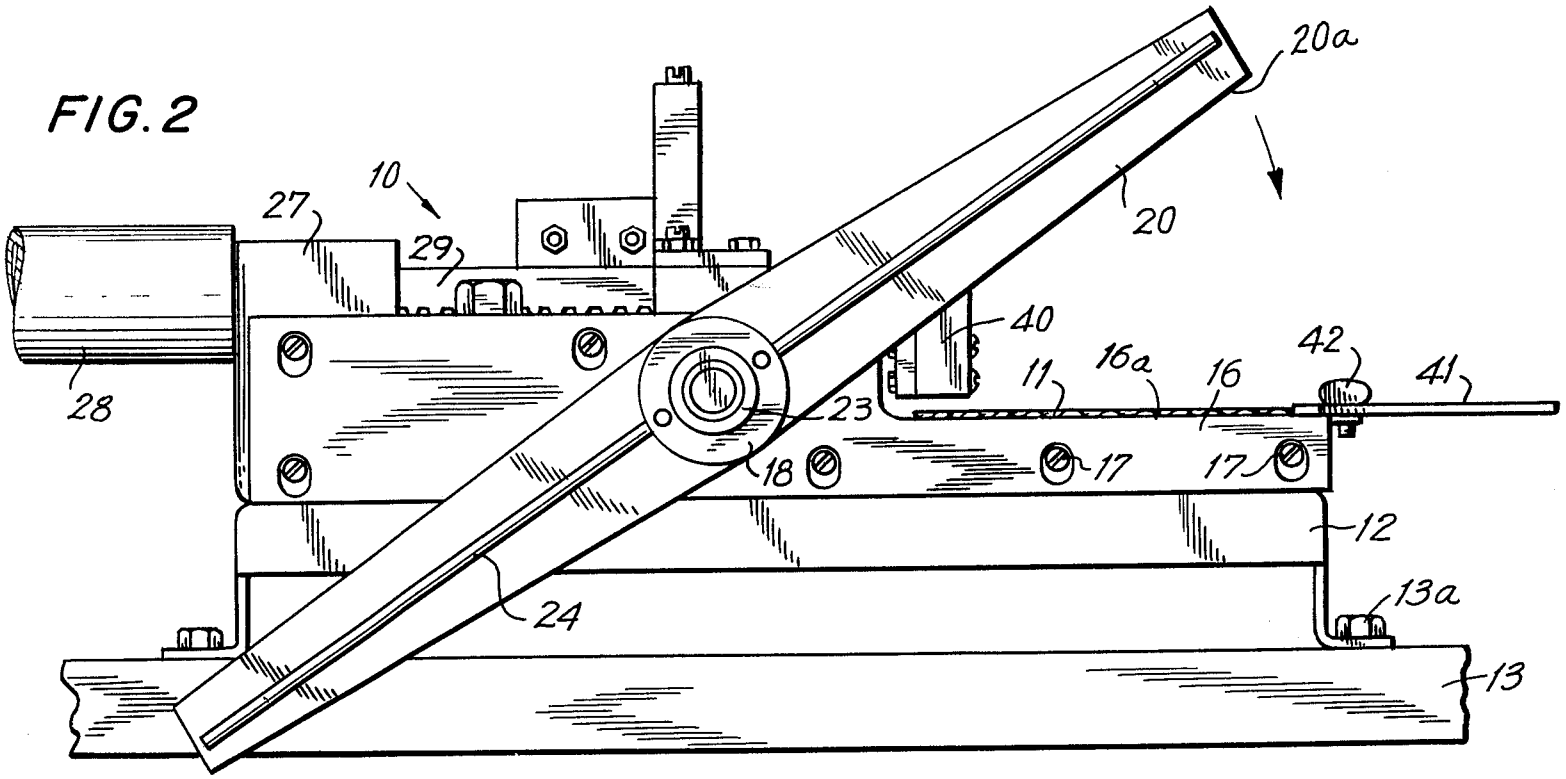
FIG. 2 is an elevational view of the rotary blade cutting mechanism depicted in FIG. 1.
Figure 4:
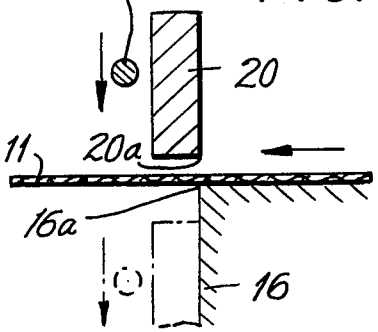
FIG. 4 is a partial sectional view taken along line 4—4 of FIG. 1.
Figure 3:
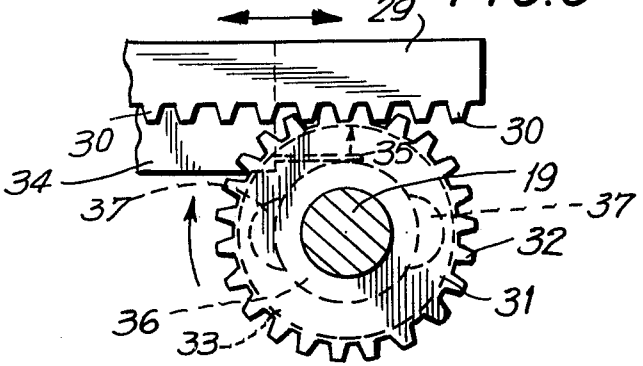
FIG. 3 is a partial sectional view taken along line 3—3 of FIG. 1.

Reference is now made to FIGS. 1 through 4 wherein a rotary blade cutting assembly, generally indicated at 10, for cutting a material 11, such as tape, ribbon, elastic, strip metal and the like, is depicted. The rotary cutting blade assembly 10 is supported by a mounting frame 12 securely fixed to a reference member 13 by bolts **13*a*. The mounting frame 12 supports a material feed plate 14 which is adapted to support a material 11 to be cut. A stationary blade 16 is mounted by screws 17 to the mounting frame 12, the stationary blade 16*a* lying substantially in the plane of the feed plate 14**.

A rotary blade 20 is keyed to a freely rotatable shaft 19 by a key 19', which shaft is journalled in mounting brackets 22 secured to mounting frame 12. Rotary blade 20 includes a cutting edge **20*a* and is cross-sectioned to a uniform thickness throughout the length thereof. Rotary blade 20 is held in pressure contact with stationary blade 16 by an elongated pressure spring 24 secured to a spring mounting plate 18, mounted on shaft 19. Pressure spring 24 further extends radially along the length of both portions of the blade and is secured to the rotary blade 20 by spring mounts 26. A coil spring 25 is disposed around the shaft 19 for applying a slight pressure to the center of the rotary blade. Pressure adjusting nuts 23 are mounted on a tapped end 21 of shaft 19 on each side of the spring mounting plate 18 to thereby allow the spring pressure on rotary blade 20 effected by coil spring 25 and elongated spring 24** to be adjustable.

It is noted that the double rotary cutting blade 20, depicted herein, is only illustrative of a preferred embodiment, and that a single cutting blade or any number of cutting blades can be mounted to shaft 19. However, it is noted that by widening the heel area of the blade and maintaining the blade flat and of uniform thickness, the rotary blade 20 is prevented from moving away from stationary blade 16 since the widened and flat heel portion near the shaft limits the deflection of the rotary blade. Moreover, rotary blade 20 includes a cutting edge **20*a* and stationary blade 16 includes a cutting edge 16*a* instead of inclined cutting edges, such inclined edges usually admitting of a shearing action. Instead, stationary blade 16 and rotary blade 20 are completely flat, one against the other, to thereby effect a cutting operation when same are brought into radial alignment, thereby clearly avoiding the excessive wear which inures to inclined blades admitting of a shearing action since such blades must be brought into slight contact with each other for each cutting operation to be effected. Note that for all parts of the cycle, some contact is maintained between rotary blade 20 and stationary blade 16** to eliminate the wear resulting when two separated blades contact each other.

A photoelectric cell 40 is mounted to mounting frame 12, and is positioned so as to detect the material 11 being fed past the cutting station along feed plate 14. In order to maintain the alignment of the material 11 as it moves in the direction indicated by the arrow in FIG. 1, a material alignment plate 41 is adapted to be adjustably positioned by thumb screw 42. The photoelectric cell 40 is coupled in a well known manner (not shown) to a solenoid air valve (not shown) to thereby energize an air cylinder 29 to thereby effect rotation of shaft 19 and hence a rotation of rotary blade 20 in a manner to be hereinafter discussed.

Air cylinder 28 is adapted to longitudinally displace a rack 29 having gear teeth 30 thereon in a first longitudinal direction in response to energization of the air cylinder. The air cylinder and rack are mounted by a bracket 27 to mounting frame 12. Rack 29 is part of a one-way gearing mechanism including a pinion gear 31 having teeth 32 adapted to be engaged by the teeth 30 on rack 29 to thereby enable same to be rotated in response to the longitudinal displacement of rack 29 by air cylinder 28. The pinion gear 31 is coupled to rotary shaft 19 through a one-way clutch 33 to thereby effect a rotation of said shaft when the rack is displaced in a first direction but not in the reverse direction. Rotation of shaft 19 effects a rotation of rotary blade 20, the amount of rotation of the shaft determines the angle or number of degrees through which the rotary blade is to be rotated. A cam 36, having lobes 37 corresponding to the position of each blade of the rotary blade 20, is mounted to the rotary shaft. The lobes are adapted to displace a finger 35 of a microswitch 34 which, in turn, effects a de-energization of the air cylinder to thereby return rack 29. A friction brake 38 arrests the rotation of the rotary blade except when being driven by rack 29. Accordingly, if two lobes are provided in the manner indicated in FIG. 1, the shaft will be rotated 180° in response to each energization of the air cylinder 28.

In operation, a material is fed into a cutting position with respect to the stationary blade 16 and is sensed by photoelectric cell 40. In response to sensing the material a signal from the photoelectric cell 40 effects an energization of the air cylinder 28 and hence a displacement of rack 29 in a first longitudinal direction. Displacement of rack 29 rotates pinion gear 31 and hence rotation of the rotary blade 20 into radial alignment with stationary blade 16 to thereby effect a cutting operation. Cam 36 mounted to shaft 19 is rotated into contact with finger 35 of microswitch 34 and in response to actuation of microswitch 34, the solenoid air valve of air cylinder 38 is actuated and the air cylinder is, in turn, actuated in the opposite direction to thereby effect a return of the gear rack, the one-way clutch mechanism 33 maintaining the blade in an idle position to thereby allow same to be prepared for the next cutting operation. Because the idle position of the rotary blade is out of alignment with the stationary blade 16, the material can be fed into a cutting position and the blade can be once again rotated to thereby repeat the cutting cycle without the necessity of reversing the direction of the rotary blade to thereby remove same from the cutting position after each cutting operation, thereby increasing the speed at which a material can be successively cut.

Accordingly, by effecting synchronization between the material feeding mechanism and the cutting blades in a well known manner, the rotary cutting blades can be rotated at high speeds to thereby increase the speed at which such cutting operations can be effected. Also, because of the flat cutting surfaces, minimal adjustments are needed due to the pressure springs. Also, the elimination of an inclined shearing edge on the blades effects a longer life and improved cutting by the blades.

It will thus be seen that the objects set forth above, among those made apparent from the preceeding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A rotary blade cutting assembly comprising a fixed cutting blade and an elongated rotary cutting blade, said elongated rotary blade having a uniform thickness and flat surfaces, the intersection of two said elongated flat cutting surfaces defining a cutting edge, said fixed blade having at least two flat intersecting surfaces defining a cutting edge, said rotary blade being adapted to rotate into radial alignment with said fixed blade to thereby effect a cutting operation, means for intermittently rotating said rotary cutting blade to effect said cutting alignment, and means for maintaining each of a flat surface of said rotary blade and a flat surface of said fixed blade defining said respective cutting edges in pressure contact during each rotary position of said rotary blade.

2. A rotary blade cutting assembly as claimed in claim 1, wherein said means for intermittently rotating said rotary cutting blade includes a one-way clutch mechanism adapted to rotate said blade through a specific angle and to bring same to rest at an idle position out of cutting alignment with said stationary blade.

3. A rotary cutting assembly as claimed in claim 1, wherein said rotary blade is mounted to a freely rotatable shaft said rotary blade and shaft including keying means for slidably mounting said rotary blade on said shaft, said pressure contact means including a coil spring biasing said rotary blade into pressure contact with said fixed blade and a pressure spring for applying a spring bias along the radial length of said rotary blade.

4. A rotary cutting assembly as claimed in claim 1, wherein said rotary blade includes two elongated blade portions extending from said pivot, each blade being adapted to effect a cutting operation during a 180° rotation of said blade, said intermittent rotating means being adapted to rotate said blade through 180° during each intermittent rotation thereof.

5. A rotary cutting assembly as claimed in claim 1, wherein said intermittent rotating means includes a one-way drive means adapted to rotate said rotary blade through a specific angle and microswitch detecting means adapted to sense the rotary position of said blade and in response to the intermittent rotation of said blade through a specific angle, effect a resetting of said intermittent rotation means.

6. A rotary cutting assembly as claimed in claim 5, wherein said rotary blade is mounted to a freely rotatable shaft, said shaft having a camming means secured thereto, said microswitch means including a means for sensing said camming means.

7. A rotary blade cutting assembly as claimed in claim 6, wherein said means for intermittently rotating said blade includes a rack, an air cylinder actuated to effect a linear motion of said rack in a first rotational drive direction, and in response to the sensing of said camming means by said microswitch means reversing the linear motion of said rack, and one-way clutch means mounted to said shaft to effect rotation of said shaft in response to the linear displacement of said rack in said first rotational drive direction, said one-way clutch means allowing said blade to remain idle when the linear motion of said rack is reversed.

* * * * *